United States Patent [19]

Kobayashi

[11] Patent Number: 4,792,066

[45] Date of Patent: Dec. 20, 1988

[54] CHEMICAL LIQUID INJECTOR

[75] Inventor: Naohiko Kobayashi, Tondabayashi, Japan

[73] Assignee: Pan American Trading Co., Ltd., Tokyo, Japan

[21] Appl. No.: 69,631

[22] PCT Filed: Sep. 3, 1986

[86] PCT No.: PCT/JP86/00448

§ 371 Date: Jun. 12, 1987

§ 102(e) Date: Jun. 12, 1987

[87] PCT Pub. No.: WO87/02404

PCT Pub. Date: Apr. 23, 1987

[30] Foreign Application Priority Data

Oct. 15, 1985 [JP] Japan ..... 60-158289[U]
Mar. 17, 1986 [JP] Japan ..... 61-60435
Apr. 28, 1986 [JP] Japan ..... 61-64978[U]

[51] Int. Cl.[4] ..... B67D 5/42; E02D 5/18

[52] U.S. Cl. ..... 222/387; 222/568; 405/269; 604/125

[58] Field of Search ..... 222/386, 387, 568, 575; 405/269; 264/32, 36; 141/2, 27, 285–310; 604/125, 121, 218, 201; 52/173, 514

[56] References Cited

U.S. PATENT DOCUMENTS

| | | | |
|---|---|---|---|
| 1,119,033 | 12/1914 | Paddock | 222/387 X |
| 2,070,206 | 2/1937 | Hudson | 222/387 X |
| 2,724,385 | 11/1955 | Lockhart | 604/125 X |
| 2,915,226 | 12/1959. | Sundholm | 222/387 X |
| 2,978,151 | 4/1961 | Sundholm | 141/27 X |
| 3,176,886 | 4/1965 | Worden | 222/387 |
| 3,291,128 | 12/1966 | O'Neil | 604/125 |
| 3,834,387 | 9/1974 | Brown | 604/125 |
| 4,090,646 | 5/1978 | Dubiel et al. | 222/387 X |
| 4,120,128 | 10/1978 | Pauls | 52/173 R |
| 4,352,262 | 10/1982 | Edelmann et al. | 52/173 R X |
| 4,382,720 | 5/1983 | Vonach | 405/269 |
| 4,402,431 | 9/1983 | Wiegner et al. | 222/207 |
| 4,430,841 | 2/1984 | Yamaguchi et al. | 52/514 X |
| 4,512,123 | 4/1985 | Fisher | 405/269 X |
| 4,555,295 | 11/1985 | Orikasa et al. | 246/36 X |
| 4,609,129 | 9/1986 | Fischer | 52/173 R X |

FOREIGN PATENT DOCUMENTS

| | | |
|---|---|---|
| 90345 | 7/1979 | Japan . |
| 66276 | 4/1982 | Japan . |
| 73844 | 5/1983 | Japan . |
| 123971 | 7/1983 | Japan . |
| 146346 | 9/1986 | Japan . |

*Primary Examiner*—Michael S. Huppert
*Assistant Examiner*—Gregory L. Huson
*Attorney, Agent, or Firm*—A. Thomas S. Safford

[57] ABSTRACT

In a chemical liquid injector mainly for use in filling with a chemical liquid cracks developed in a wall of a concrete building and a gap between the wall and the underlying concrete body, an air-escape groove is provided in the interior surface of the injector casing. While in use a mouthpiece is attached to a nozzle of the injector.

6 Claims, 6 Drawing Sheets

CHEMICAL LIQUID INJECTOR

TECHNICAL FIELD

The present invention relates to an improved chemical liquid dispenser or injector which is of particular utility when employed in reinforcing of concrete buildings or similar structures by filling cracks in their bodies or walls with a chemical liquid.

BACKGROUND ART

For repairing walls of a concrete building, for instance, loosened from or lifted off the underlying concrete body due to cracks developed therein, there has been proposed in Japanese Utility Model Application No. 27713/85 a grease gun type chemical liquid injector adapted for automatically delivering a chemical liquid through utilization of the thrust by a spring. The conventional injector has a structure in which a chemical liquid of relatively high viscosity, contained directly in the injector casing or body, is discharged by a spring-loaded piston slidably received therein. Wit this structure, however, since the piston must be removed from the injector casing along with its cap, for loading the injector with the liquid, air is naturally entrapped in the casing between the liquid and the piston head when the piston has been re-inserted into he injector body. Consequently, as the chemical liquid is forced into, for instance, a crack in a wall by the piston, the air in the casing inevitably finds its way into the liquid being delivered, and it remains in the crack in the form of bubbles, offering a serious hindrance to the crack-mending work.

Furthermore, in the case of repairing a wall lifted off the underlying concrete body by injecting the chemical liquid into the gap therebetween, air remaining in the gap is gradually driven into its innermost part and is not purged out therefrom. This leads to a substantial reduction of the injection rate, making the repair work difficult.

It is therefore an object of the present invention to provide a chemical liquid injector which is automatically purged of air entrapped between the chemical liquid and the piston head by the insertion of the piston into the injector body, permitting efficient injection of the chemical liquid.

DISCLOSURE OF THE INVENTION

The chemical liquid injector of the present invention comprises a cylindrical injector casing or body having at one end a nozzle molded integrally therewith and adapted to threadably engage a mouthpiece and open at the other end, a piston slidably received in the injector casing, a cap threadably attached to the open end of the injector casing,, and a coiled spring mounted on the piston rod between the piston head and the cap, for applying thrust to the piston. The piston rod projects out of the injector body through the cap and is adapted to be locked to the cap, with the coiled spring held in its compressed state therebetween. The interior surface of the injector casing has cut therein a shallow air-escape groove or grooves which extend lengthwise of the casing from its open end to the position that the piston head will assume when the piston is locked at its fully retracted position in the casing.

Moreover, the mouthpiece which is threadably attached to the nozzle comprises a tapered tubular inner body made of synthetic resin and having a number of lugs formed on its outer peripheral surface and a sheath similarly made of synthetic resin and fitting closely to the inner body. The sheath has a slit along the entire length thereof, small holes for receiving the lugs of the holder, and a plurality of narrow projections formed on the interior surface of the sheath and extending in its lengthwise direction. The mouthpiece of such a construction enables air in a crack in a wall or a gap between it and the underlying concrete body to be purged out therefrom, ensuring smooth injection thereinto of the chemical liquid.

With such a structure as described above, even if a chemical liquid of high viscosity is employed, air entrapped in the injector casing can automatically be purged out therefrom through the air-escape grooves as the piston is loaded into the injector casing; so that no air bubbles form in the liquid being delivered.

Accordingly, the chemical liquid injector of the present invention is simple-structured, low-cost, and of great utility in practical use.

BEST MODE FOR CARRYING OUT THE INVENTION

A detailed description will be give of an embodiment of the chemical liquid injector of the present invention.

Figure 1:
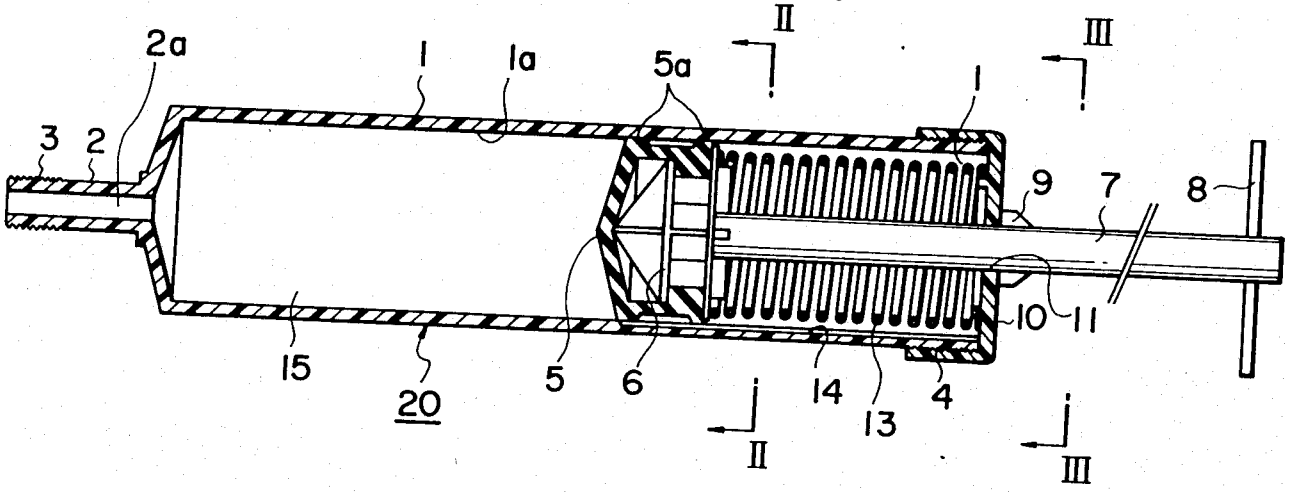
FIG. 1 is a longitudinal-sectional view illustrating an embodiment of the chemical liquid injector of the present invention.
Figure 2:
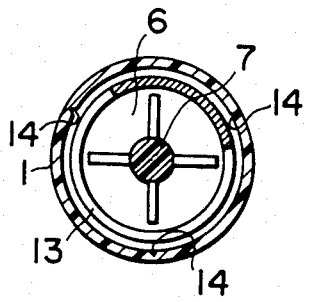
FIG. 2 is a cross-sectional view taken on the line II—II in FIG. 1.
Figure 3:
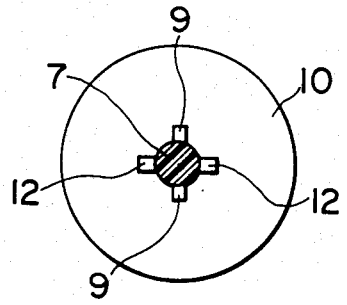
FIG. 3 is a cross-sectional view taken on the line III—III in FIG. 1.

In FIGS. 1 through 3, reference numeral 1 indicates a cylindrical injector casing, which is a molding of transparent synthetic resin. The casing 1 is closed at one end but has a nozzle 2 protrusively provided on the closed end face centrally thereof, while the other end is open but is normally closed by a cap 10 threadably attached thereto. Reference numeral 2*a* identifies a chemical liquid outlet port. A screw thread 3 is cut around the top end portion of the nozzle 2 for thread-mounting thereon a mouthpiece. A screw thread 4 is cut around the open end portion of the casing 1 for threadably attaching thereto the cap. Reference numeral 5 designates a piston, which is made of an elastic material such as synthetic rubber, and has a plurality of flanges 5*a* standing out from its outer peripheral surface. The piston 5 is fixedly secured on a support head 6 so that the flanges 5*a* are held in sliding contact with the interior surface 1*a* of the casing 1; namely, the piston 5 is slidably received in the casing 1. The support head 6 has a rod 7 extending rearwardly from the center thereof. Reference numeral 8 denotes a piston manipulating handle and 9 stoppers protrusively provided on the piston rod 7. The reference numeral 10 denotes the above-mentioned cap, which is normally thread-mounted on the casing 1 at the open end thereof. The cap 10 has a centrally-disposed through hole 11 for receiving the piston rod 7 and a pair of opposed slits 12 extending across the hole 11 for receiving the blade-shaped locking pieces 9, as shown in FIG. 3. Reference numeral 13 represents a coiled spring mounted on the piston rod 7 between the piston 5 and the cap 10, for yieldingly urging the piston 5 to deliver the chemical liquid. Reference numeral 15 identifies a chemical liquid chamber.

The interior surface 1*a* of the casing 1 of the chemical liquid injector, generally indicated by 20, has cut therein one or more longitudial air-escape grooves 14 which extend from the open end 1*b* of the casing 1 to the position where the piston 5 will lie when it is held at its fully retracted position in the casing 1 by locking the locking pieces 9 of the piston rod 7 to the outer end face of the cap 10. The air-escape grooves 14 may be cut, for instance, in a V-shaped, shallow U-shaped or semi-circular cross-section.

The piston rod 7 may also be locked to the cap 10 by inserting a pin into a hole made in the rod 7, instead of using the locking pieces 9.

Figure 4:
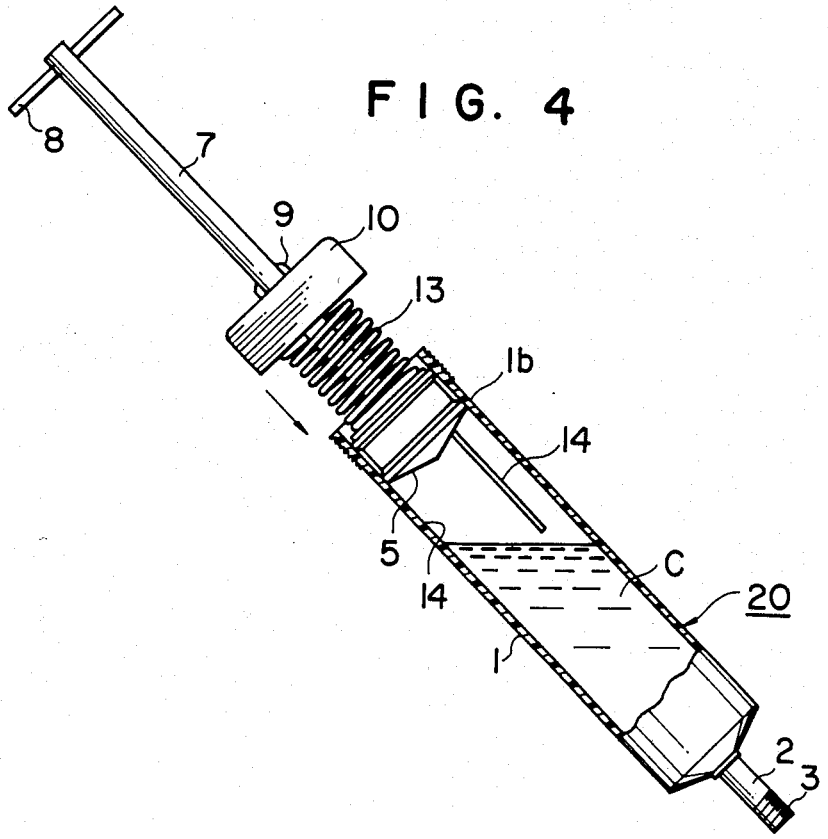
FIG. 4 is a diagram schematically showing the state in which the piston is being inserted into the injector casing.

To fill the injector 20 with the chemical liquid, the piston 5 is fully retracted and locked to the cap 10, with the coiled spring 13 compressed between the cap 10 and the piston 5, and then the piston 5, the cap 10, and the coiled spring 13 thus locked as one body are removed together from the casing 1. After loading a required amount of liquid (The amount of liquid filled can be confirmed by reading graduations provided on the outer peripheral surface of the casing 1), the piston 5 locked to the cap 10 is forced into the casing 1 from its open end 1*b*, as show in FIG. 4. In this instance, as the piston 5 is pushed forward, air entrapped between the chemical liquid C and the piston head is gradually compressed and driven out of the casing 1 through the air-escape grooves 14 leading to the open end 1*b* of the casing 1. In this way, the casing 1 is completely purged of air by the time when the piston 5 reaches a predetermined position where it makes contact with the chemical liquid C, and at the point of time when the chemical liquid C partly enters into the air-escape grooves 14, the piston 5 moves past the extreme ends of the grooves 14, inhibiting the liquid C from flowing thereinto.

Next, a description will be given of the actual mending of a crack in a concrete body or a wall lifted off the underlying concrete body, through use of the chemical liquid injector 20. Preparatory to the injection of the chemical liquid, a hole 26 for inserting the mouthpiece 40 is drilled in the wall or concrete body.

Figure 5:
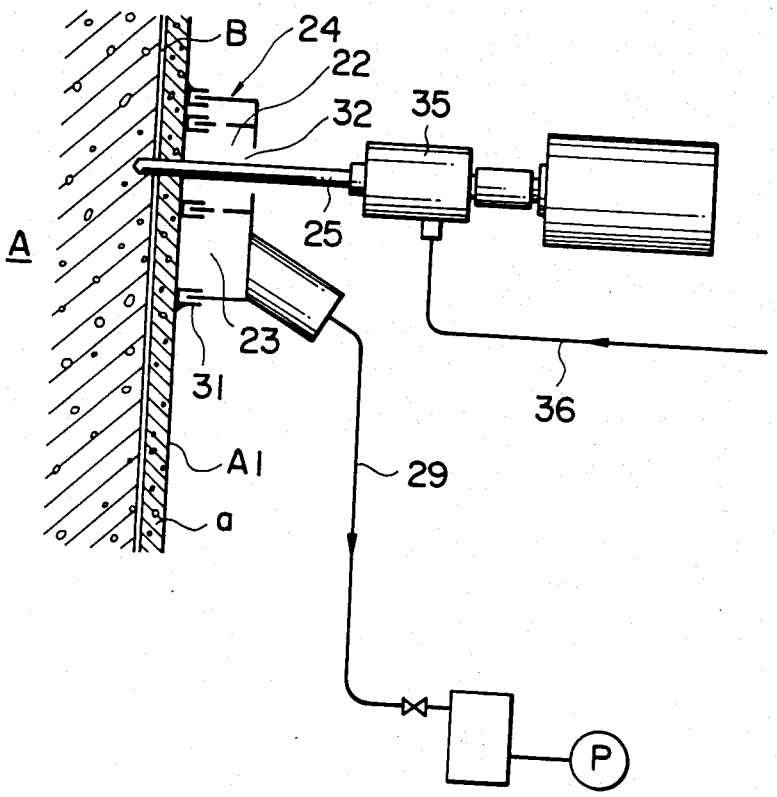
FIGS. 5 and 6 are diagrams schematically showing how a hole is drilled in the wall to be repaired, prior to the actual injection thereinto of the chemical liquid.
Figure 6:
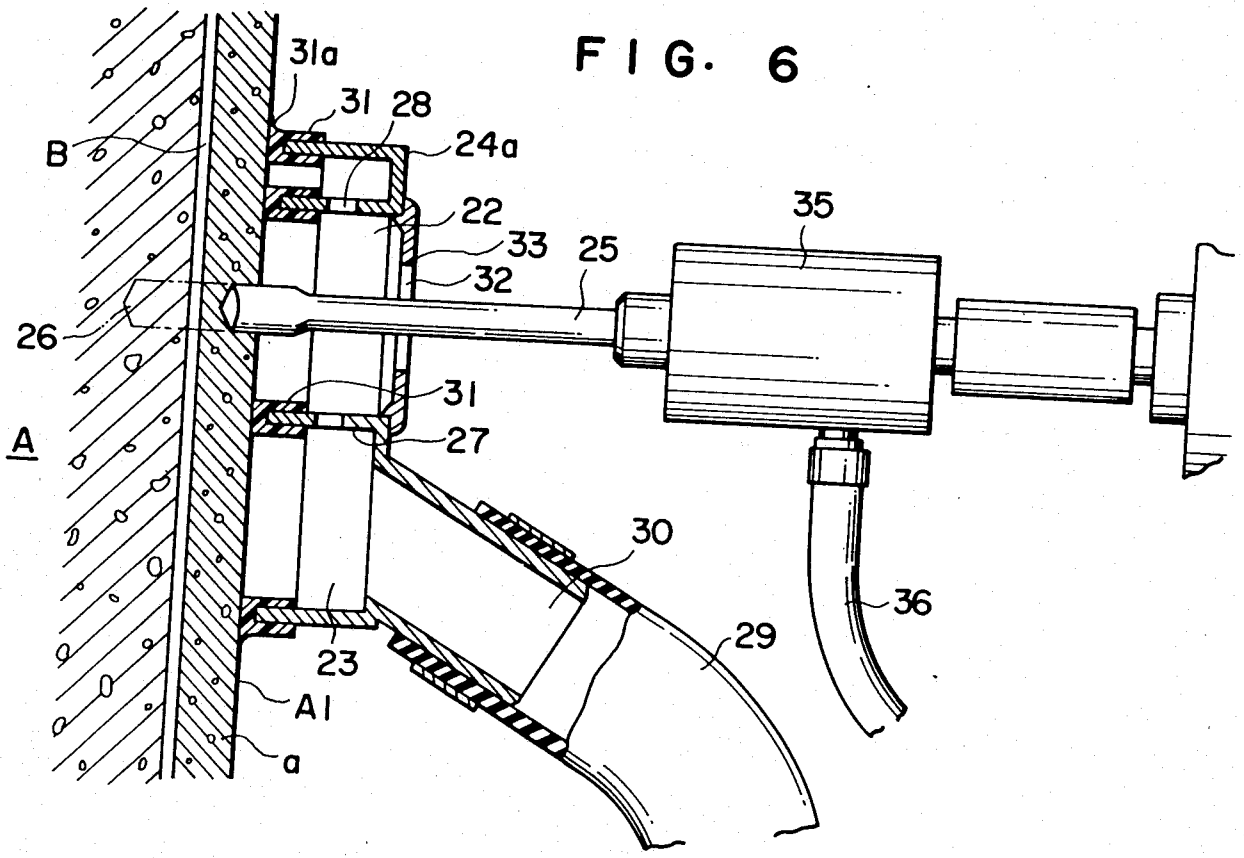

For drilling the hole, a dust catcher 24 and a drill 25 of the type jetting out water from its tip are employed as show in FIGS. 5 and 6.

The dust catcher 24 comprises a dust collecting chamber 22 which is sealingly disposed on the wall around the area where to be drilled, for collecting concrete shavings and water jetted out from the drill 25, and a dust removing chamber 23 which is connected to a suction pump P, for creating a negative pressure in the dust collecting chamber 22 and for drawing out therefrom the concrete shavings together with the water. Further, the dust catcher 24 is adapted to sealingly stick fast, on one side, to the wall surface to be drilled. The hole 26 is drilled by the core drill 25 while jetting out therefrom water into the dust collecting chamber 22 of the dust catcher 24 stuck fast to the wall surface, and at the same time the resulting concrete shavings and waste water are removed by means of the suction pump P.

The body 24*a* of the dust catcher 24 is a flat, cylindrical, molding of synthetic resin open at one end. The dust collecting chamber 22 is defined by a cylindrical partition wall 27 eccentrically with respect to the body 24*a*. The dust collecting chamber 22 and the dust removing chamber 23, which is provided in the body 24*a* adjacent thereto,, inter communicate through a number of through holes 28 made in the partition wall 27. The dust removing chamber 23 has a tube 30 for receiving a pipe 29 connected to the suction pump P. In order to make the chambers 22 and 23 airtight, seal rings 31 are secured to marginal edges of their open ends. The seal ring 31 attached to the marginal edge of the body 24*a* is formed thin at its outer peripheral portion 31*a* so that it adheres firmly to the wall surface.

The body 24*a* has a drill insertion hole 32 in the back of the dust collecting chamber 22 concentrically therewith, and a rubber cap 33 is fitted into the hole 23 for preventing the body 24*a* from being broken even if touched by the rotating drill.

In the case of repairing the exterior wall a lifted off the underlying concrete body A through use of the chemical liquid injector, it is preferable to set an area over which the wall xwK is considered to be lifted off and to drill a hole at an adequate position prior to the injection of the chemical liquid into the gap B between the wall xwK and the concrete body A. At first, the dust catcher 24 is held against the wall surface Al with the dust collecting chamber 22 disposed around the position where to be drilled, and then the suction pump P is actuated, by which the inside of the body 24*a* is evacuated, causing it to stick fast to the wall surface Al. Then, the drill 25, which is connected to the output shaft of a drive motor (not shown) through a water supply unit 35, is pressed against the wall surface Al through the drill insertion hole 32 of the dust catcher 24, thus drilling a hole. During drilling a proper amount of water is jetted out from the tip of the drill 25 through a hose 36 connected to the water supply unit 35. In consequence, concrete shavings and dirt are flushed away with water and drawn out of the dust collecting chamber 22 and into the dust removing chamber 23 through the through holes 28 by the force of the pump P, thereafter being rapidly fed to a separator (not shown) provided in association with the pipe 29 connected to the suction pump P.

With such combined use of the core drill 25 and the dust catcher 24, it is possible to perform drilling without splashing concrete shavings and water about. Moreover, as the drill 25 is pushed forward into the concrete body A across the gap B, concrete shavings and water naturally enter into the gap B, but they are all drawn out therefrom; so that no excessive drilling takes place and the hole 26 can be drilled to a desired depth.

The dust catcher 24 can easily be demounted from the wall surface 1*a* simply by closing a valve provided in the pipe 29. That is, upon stopping the pumping operation, the negative pressure applied to the inside of the body 24*a* is immediately lost, thus removing the force of adhesion of the body 24*a* t the wall surface 1*a* through the seal rings 31.

Figure 11:
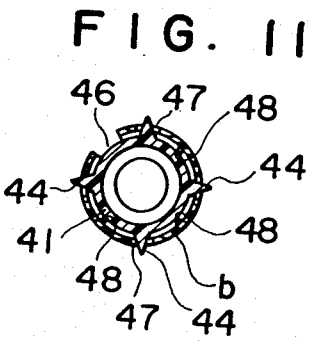
FIG. 11 is a cross-sectional view taken on the line V—V in FIG. 8.
Figure 10:
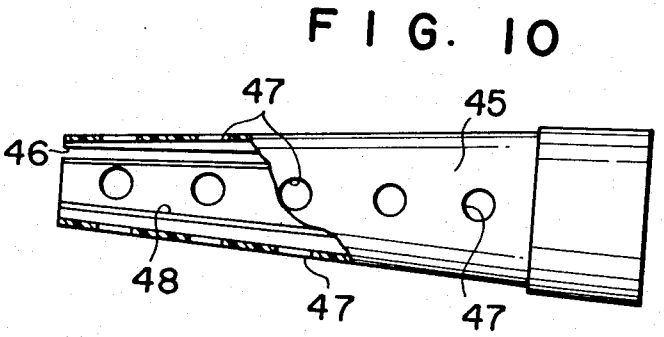
FIG. 10 is a side view of the mouthpiece, with its sheath partly broken away.

After drilling the hole 26 as described above, the chemical liquid injector 20 is mounted on the wall surface 1*a* by forcing the mouthpiece 40 into the hole 26. In this instance, it is preferable that the mouthpiece 40 be of such a structure as shown in FIGS. 7 to 11. The inner body 41 of the mouthpiece 40 is a relatively thin, gently tapered tubular molding of polyethylene, polypropyrene or like synthetic resin. The inner body 41 has a female screw thread 43 cut in the interior surface of its base portion 42 for receiving the male screw thread 3 cut in the exterior surface of the top en portion of the nozzle 2 projecting out from the closed end of the casing 1. On the outer periphery of the inner body 41 there are formed integrally therewith a number of lugs 44 which are aligned at predetermined intervals in the axial direction and spaced apart an angular distance of 90 degrees in the circumferential direction. A sheath 45 fitting closely to the inner body 41 is also a thin, gently tapered tubular molding of synthetic resin, which is similar in shape to the inner body 41. The sheath 45 has a slit 46 extending along the entire length thereof and small openings 47 for receiving the lugs 44. Furthermore, the sheath 45 has a plurality of longitudinally extending thin protrusions 48 formed on the inside thereof between apertures 47 at three circumferentially spaced positions, as depicted in FIG. 11.

Figure 7:
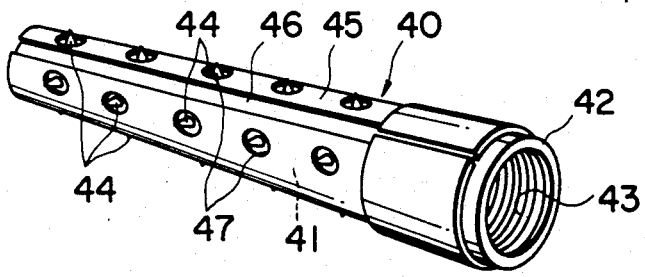
FIG. 7 is a perspective view showing the external appearance of a mouthpiece for use with the chemical liquid injector of the present invention.
Figure 8:
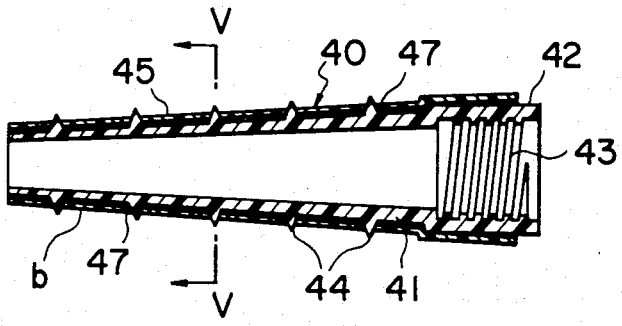
FIG. 8 is its longitudinal-sectional view.
Figure 9:
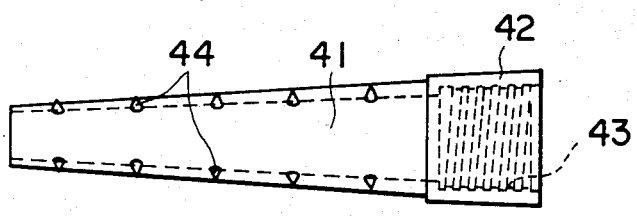
FIG. 9 is a side view of its inner body (viewed as rotated 45° from the orientation shown in FIG. 8)

By spreading it wide open along the slit 46 the sheath 45 can be easily put on the inner body 41 as shown in FIGS. 7 and 8. Since the body 41 and the sheath 45 are tapered, the mouthpiece 40 can be inserted into the hole 26 irrespective of its diameter. The lugs 44 frictionally engage the interior surface of the hole 26 and are partly deformed, by which the mouthpiece 40 is locked in place in the hole 26. Accordingly, the height of the lugs 44 is selected such that the diameter of a circle including their tips is larger than the nominal diameter of the hole 26.

The mouthpiece 40, which has its inner body 41 wrapped with the sheath 45 as depicted in FIG. 8, is attached to the nozzle 2 of the chemical liquid injector 20 through threaded engagement of the female screw 43 of the former with the male screw 3 of the latter. As noted previously, the chemical liquid injector 20 is preloaded with the required amount of chemical liquid in the injector casing 1 and the coiled spring 13 is held in its locked sxwKate through engagement of the locking pieces 9 with the cap 10.

Figure 12:
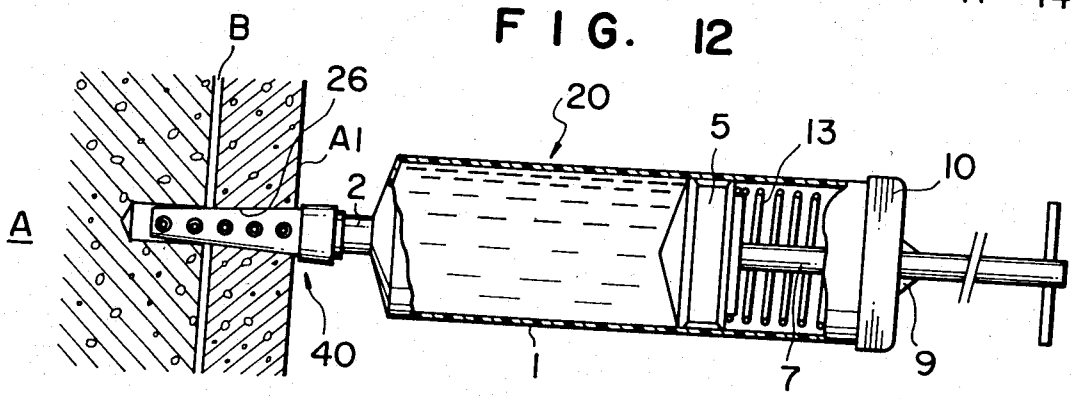
FIG. 12 is a diagram showing the chemical liquid injector with the mouthpiece attached thereto.

By pressing the chemical liquid injector 20 with the tip of the mouthpiece 40 held against the hole 26 drilled in the wall of the concrete building, the mouthpiece 40 is forced into the hole 26. At this time, the lugs 44 of the mouthpiece 40 are urged against the inner surface of the hole 26 and into frictional engagement therewith while being partly deformed, by which the mouthpiece 40 is firmly retained in the hole 26. Consequently, the entire chemical liquid injector 20 is stably mounted on the wall Al, as shown in FIG. 12. Then, turning the piston rod 7 with the handle 8 to bring the locking pieces 9 into alignment with the slits 12 of the cap 10, the coiled spring 13 is unlocked and allowed to start urging the piston head 5 forward. Thus, the chemical liquid contained in the injector 20 is forced out therefrom into the gap B in the wall Al through the nozzle 2 and the mouthpiece 40.

In this case, the hole 26 is closed by the mouthpiece 40, but since air gaps b, though narrow, are defined between the inner body 41 and the sheath 45 of the mouthpiece 40 by the lugs 44 of the former and the split 46 of the latter, air remaining in the hole 26 is rapidly purged out thereof through the air gaps b as the chemical liquid is forced out of the mouthpiece 40 and into the gap B in the wall Al. Accordingly, no air remains at the tip of the mouthpiece 40. This ensures smooth injection of the chemical liquid into the gap B in the wall Al through the thrust of the coiled spring 13.

After completion of the injection of the chemical liquid, the injector 20 is unscrewed from the mouthpiece 40 for further use. Where the mouthpiece 40 left in the hole 26 projects out therefrom on the wall Al, the projecting end portion is cut off after solidification of the injected chemical liquid and then the exposed portion is covered with putty. Where the mouthpiece 40 does not markedly protrude, it is simply covered with putty.

While in the above the mouthpiece is forced into the hole drilled in the wall after being threadably attached to the chemical liquid injector, it is possible, of course, to press the mouthpiece into the hole first and then thread-mount the injector to the mouthpiece.

Furthermore, the chemical liquid injector 20 of the present invention is not limited specifically to the case where the hole is drilled in the wall for receiving the mouthpiece as described above. That is, the injector can be used without involving the necessity of drilling the hole in the wall to be repaired. For instance, when cracks developed in the wall are very fine, a sucking-disc-type washer (not shown) is fixedly mounted on the wall, covering the cracks, and the nozzle of the chemical liquid injector is inserted into a tubular member disposed centrally of the washer and contiguous to an opening made in the bottom of the washer. In this way, the chemical liquid is injected into the cracks through the tubular member of the washer by virtue of a capillary phenomenon.

INDUSTRIAL APPLICABILITY

As described above, the chemical liquid injector of the present invention is suitable for use in the injection of a chemical liquid into cracks in a wall of a concrete building and a gap between the underlying concrete body and a wall loosened therefrom.

I claim:

1. A chemical liquid injector which comprises a cylindrical injector casing having at its front end a nozzle and at the open rear end means for receiving a cap, a piston slidably received in the injector casing, a cap detachably mounted on the injector casing at the open rear end thereof, a piston rod secured to the rear end of said piston and projecting through a hole in the cap, a coiled spring interposed along said rod between the piston and the cap for urging the piston forward, means for locking the coiled spring in its compressed state, at least one air-escape groove formed in the interior surface of the injector casing which extends lengthwise of the casing from its open end to the position where the piston head will lie when the piston is held at its fully retracted position in the casing, the nozzle of the injector casing having threadably attached thereto a mouthpiece, the mouthpiece comprising an inner body made of synthetic resin and having a plurality of lugs protrusively provided on its outer peripheral surface and a sheath similarly made of synthetic resin and fitting closely to the inner body, the sheath having a slit extending along the entire length thereof, small holes for receiving the lugs, and a plurality of thin projections formed on the interior surface of the sheath and extending its axial direction.

2. A cylindrical injector casing having a nozzle at its proximal end and adapted to have a reciprocal air-tight piston operative therein for use in apparatus for injecting a flowable non-gaseous material comprising an air-bypass groove formed in the interior surface of the injector casing which extends lengthwise of the casing from its distal end to a predetermined fill point for said flowable material, which point is at a proximal distance sufficient to at least permit accommodation of the piston within the casing on the distal side of said point, a mouthpiece fastened on the free end of said nozzle, said mouthpiece comprising a tapered open-ended hollow inner body having a plurality of stiffly-deformable lugs protrusively provided in a spaced array along and around its outer peripheral surface, an external correspondingly-tapered sheath made of a stiffly yieldable material and fitting closely spaced over the inner body, the sheath having a narrow slit extending along the length thereof, small holes for loosely accommodating respective lugs projecting therethrough, a plurality of small raised axial spacing ribs formed on at least one of the interior surface of the sheath and/or of the exterior surface of the inner body, and fastening means for joining the larger end of the tapered mouthpiece to said injector apparatus.

3. A mouthpiece for apparatus for injecting flowable non-gaseous material comprising a tapered open-ended hollow inner body having a plurality of stiffly-deformable lugs protrusively provided in a spaced array along and around its outer peripheral surface, an external correspondingly-tapered sheath made of a stiffly yieldable material and fitting closely spaced over the inner body, the sheath having a narrow slit extending along the length thereof, small holes for loosely accommodating respective lugs projecting therethrough, a plurality of small raised axial spacing ribs formed on at least one of the interior surface of the sheath and/or of the exterior surface of the inner body, and fastening means for joining the larger end of the tapered mouthpiece to said injector apparatus.

4. A mouthpiece according to claim 3, wherein said sheath and inner body are made from synthetic resin, said lugs and said respective holes in the sheath are aligned at predetermined intervals in the axial direction and are spaced at 90° circumferentially.

5. A mouthpiece according to claim 4, wherein said ribs are three in number spaced circumferentially at 90° and said slit is spaced at least 90° from said ribs.

6. A mouthpiece according to claim 5, wherein said fastening means comprises a base portion formed at the lower distal end of said inner body which base portion is internally threaded, said sheath extends over said base portion, and said slit is narrower over the base portion than over the more proximal tapered portion of the inner body.

* * * * *